US007654314B2

(12) United States Patent
Farris

(10) Patent No.: US 7,654,314 B2
(45) Date of Patent: Feb. 2, 2010

(54) CHEMICAL DELIVERY SYSTEM FOR PLUNGER LIFT

(76) Inventor: Sam Farris, 129 Briarwood St., Oklahoma City, OK (US) 73160

( * ) Notice: Subject to any disclaimer, the term of this patent is extended or adjusted under 35 U.S.C. 154(b) by 108 days.

(21) Appl. No.: 11/834,847

(22) Filed: Aug. 7, 2007

(65) Prior Publication Data

US 2009/0038788 A1 Feb. 12, 2009

(51) Int. Cl.
*E21B 19/00* (2006.01)
*E21B 43/00* (2006.01)

(52) U.S. Cl. ..... 166/90.1; 166/68; 166/902; 166/310; 166/263

(58) Field of Classification Search ..... 166/263, 166/90.1, 902, 310
See application file for complete search history.

(56) References Cited

U.S. PATENT DOCUMENTS 3,412,798 A * 11/1968 Gregston ..... 417/56
4,042,033 A * 8/1977 Holland et al. ..... 166/310
4,224,993 A * 9/1980 Huckaby ..... 166/325
5,052,484 A * 10/1991 Gesta ..... 166/55
5,450,897 A * 9/1995 Brown ..... 166/68
7,004,258 B2 2/2006 Farris

* cited by examiner

*Primary Examiner*—David J Bagnell
*Assistant Examiner*—Catherine Loikith
(74) *Attorney, Agent, or Firm*—R. William Graham

(57) ABSTRACT

An improvement in a chemical delivery system for a plunger lift for enhancing oil and gas recovery in a well having a well head and which employs a plunger includes a chamber communicably connected to a top of the well head and operably disposed thereon and including a ball check valve device which controls communication between a first section which receives chemicals therein for delivery into the well and a second section which communicates chemicals from the first section to a plunger in the well, and means for retaining the ball valve in one of an open position and a closed position as a function of the well being shut in.

3 Claims, 3 Drawing Sheets

CHEMICAL DELIVERY SYSTEM FOR PLUNGER LIFT

BACKGROUND OF THE INVENTION

1. Field of the Invention

The present invention relates generally to apparatus for increasing oil and gas recovery. More particularly, but not by way of limitation, the invention relates to improvements in chemical delivery system for a plunger lift used in wells.

2. Related Art

In the recovery of oil from oil-bearing reservoirs, it is often possible to recover only a portion of the oil contained in the underground formation by the so-called primary recovery methods which utilize the natural forces present in the reservoir. Thus, a variety of enhanced recovery techniques, so-called secondary or tertiary recovery have been employed in order to increase the recovery of oil from subterranean reservoirs.

The inventor or the instant invention provided an improvement in the field by providing apparatus for increasing oil and gas recovery in a well by enhancing oil and gas flow therein. In that invention, the apparatus includes a delivery mechanism which has chamber and valve mechanism for automatically delivering a flow enhancing substance to a head of the well and further included a plunger which includes a storage compartment with a valve for automatically receiving the flow enhancing substance from the delivery mechanism at the well head and releasing the flow enhancing substance upon reaching a lower portion of the well.

The prior invention was an improvement over chemical activated oil and gas flow enhancing liquids and sticks, such as soaps, which are commonly known to reduce scale, paraffin and the viscosity of the fluids in the well and thus increase production of oil and gas recovery. The prior invention was thought to be more economical or practical due to a reduction in manual intervention, additional equipment and costs associated therewith.

While the inventor provided improvement over the art, there remains a need to improve upon the delivery system. The current invention provides an improvement over the same.

SUMMARY OF THE INVENTION

An object is to improve secondary oil and gas recovery using an improved chemical delivery system.

Another object is to increase oil and gas production in an automated manner.

Accordingly, the present invention is directed to chemical delivery system for a plunger lift for enhancing oil and gas recovery in a well. The system includes improvements in the means for automatically delivering a flow enhancing substance to a head of the well. There is provided lubricator piping connected to a tubing string and a controller having a sensor operably interconnected to the lubricator piping and a supply container containing a flow enhancing substance which is further operably connected to a sales flow line, the controller is programmed to sense when well flow diminishes below a predetermined flow rate and is equipped to shut in the well through a flow control valve operably connected to the sales flow line. A plunger is operably disposed in a manner to move within the tubing string and the lubricating piping and has means for automatically receiving the flow enhancing substance from the delivering means at the well head and releasing the flow enhancing substance upon reaching a lower portion of the well.

The improvement includes modifications to the delivery means which includes a chamber communicably connected to a top of a well head. Operably disposed within the chamber is a valve device which controls communication between two sections of the chamber. More particularly, the valve device can be disposed in a first annular member which extends radially inward from the chamber wall. An annular valve seat is fixably disposed in an inner surface of the annular member.

A ball valve cage is fixably connected to the annular seat and extends into the first section of the chamber. Openings are formed in the ball valve cage adjacent a first end thereof near the annular seat. Another opening is formed at a second end of the ball valve cage. A ball retainer extends inwardly from a ball valve cage wall and is disposed between the ends of the ball valve cage. A ball valve is movably disposed within the ball valve cage such that the ball can be moved between a first closed position wherein the ball valve is seated on the annular seat to prevent fluid flow to pass therethrough at the first end and a second open position wherein the ball valve is seated against opening at the second end wherein fluid flow is permitted to pass through openings at the first end and through annular seat.

A dip tube provided includes a radially enlarged first end an elongated second end having a relatively smaller radius to the first end. The first end also includes a cushioning member for impact absorption when striking the ball valve. In this regard, the dip tube is generally movably disposed within the second section of the chamber with the first end capable of passing through the annular seat. A first annular impact stop for impacting adjacent the first annular member receives the elongated end of the dip tube therethrough while preventing the first end of the dip tube from passing therethrough. A second annular impact stop receives the elongated end therethrough and a spring is disposed between the stops and biases against them. A second annular member extends radially inward within the second section of the chamber to retain the stop.

The first section of the chamber comprises an area which receives the chemical to be delivered into the well. Operably disposed within the first section adjacent a terminal end of the first section is a spring retainer (referred to as a "chemical spring follower") and a disk (referred to as a "chemical chamber spring follower") and a spring disposed therebetween which biases against them. The disk has a protruding member which is configured to extend through the opening of the second end of the ball valve cage and displace the ball valve from the open position to the closed position. The disk has an annular seal to prevent fluid passing thereby along the chamber.

By so providing, the present invention enables oil and gas flow enhancing material delivery in an improved automated manner with minimal cost and modification to existing equipment. In doing so, improved oil and gas recovery is obtained. Other objects and advantages will be readily apparent to those skilled in the art upon viewing the drawings and reading the detailed description hereafter.

DETAILED DESCRIPTION OF THE PREFERRED EMBODIMENT

Figure 1B:
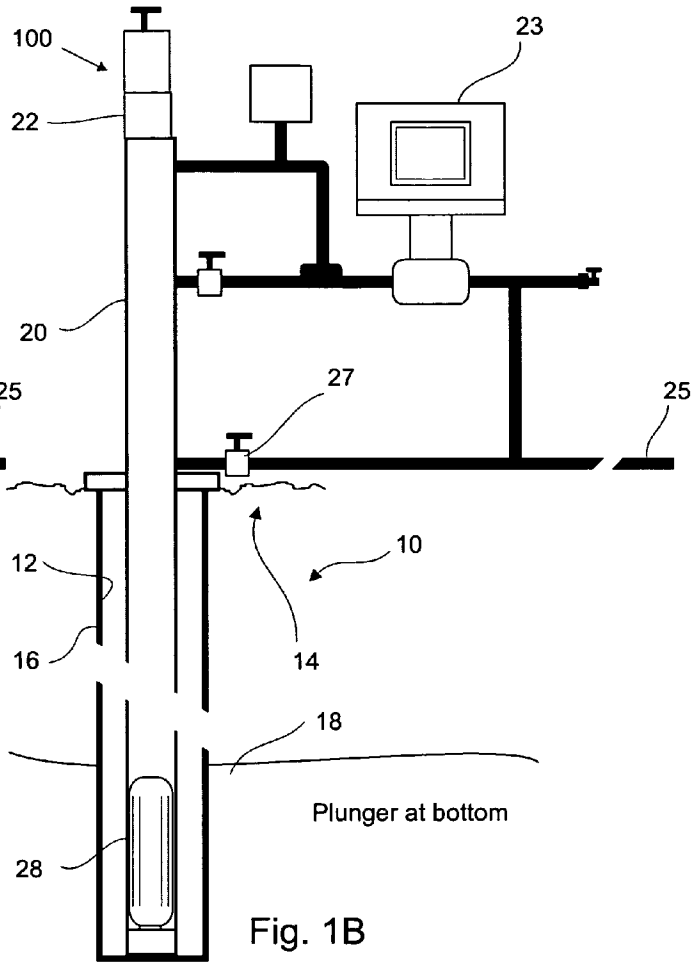
FIG. 1B is a longitudinal schematic of well having an automated delivery mechanism and plunger of the present invention therein in another mode.
Figure 1A:
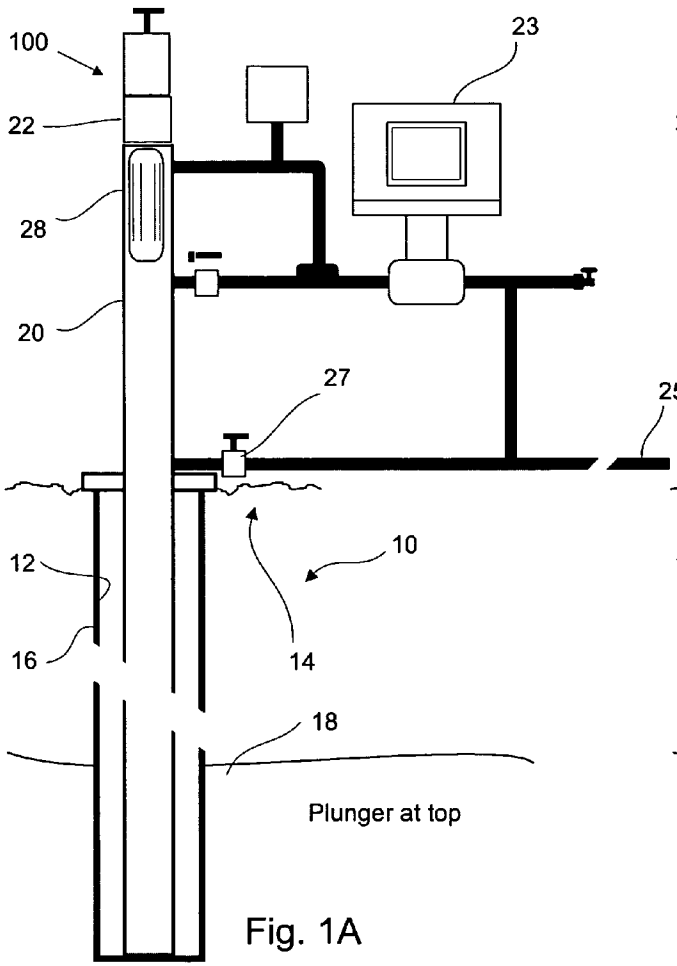
FIG. 1A is a longitudinal schematic of well having an automated delivery mechanism and plunger of the present invention therein in one mode.
Figure 2:
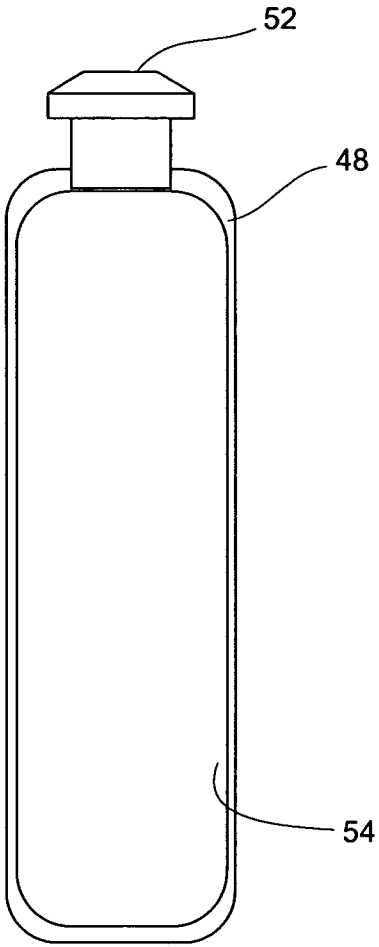
FIG. 2 is a cross section of an embodiment of a plunger which can be employed in FIG. 1.
Figure 3:
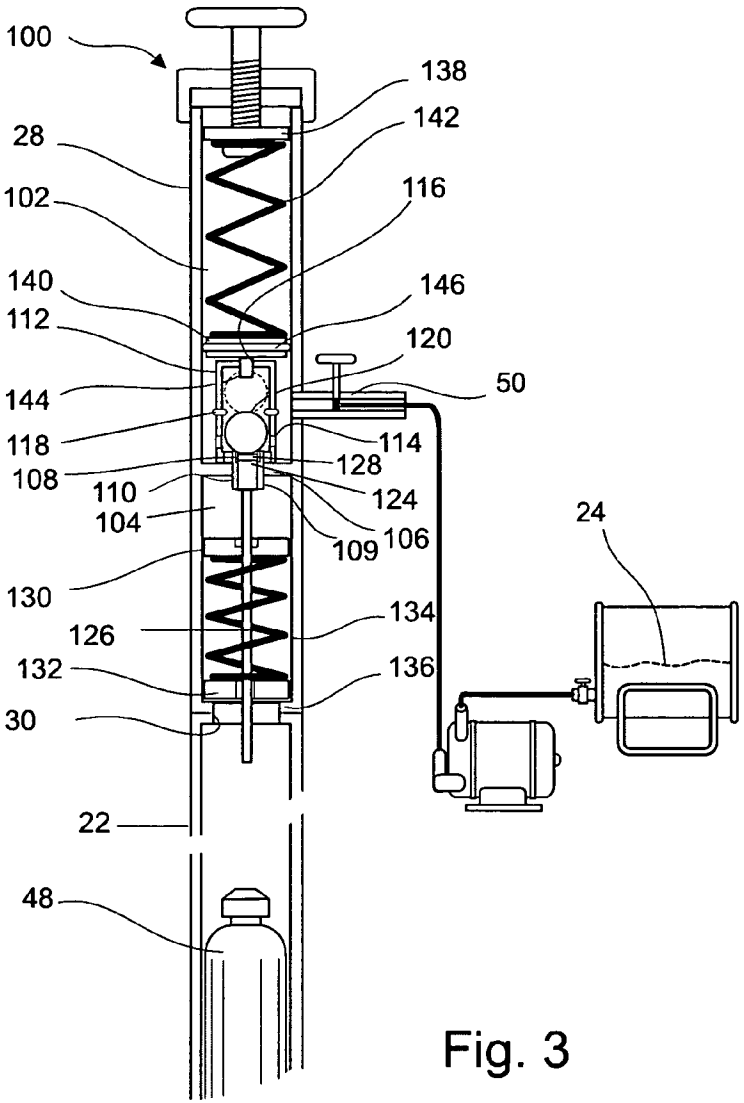
FIG. 3 is a schematic showing one mode of operation of the present invention showing a chamber on a modified well cap being filled with chemical.
Figure 4:
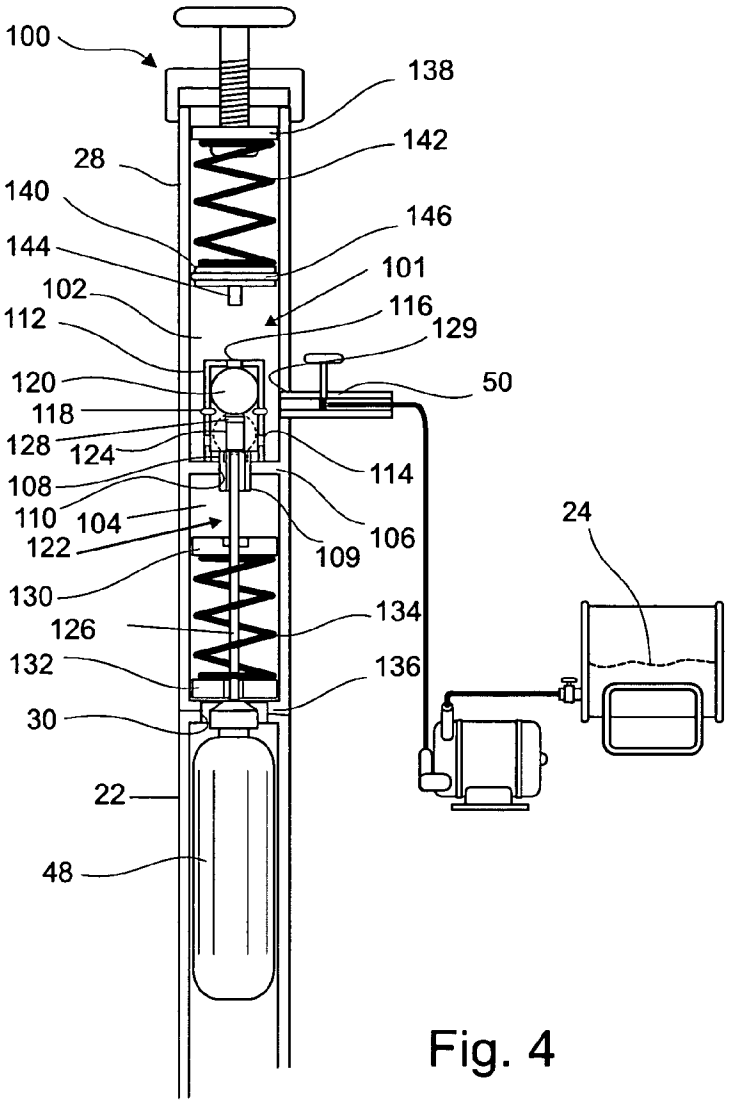
FIG. 4 is a schematic showing another mode of operation of the present invention showing the delivery of chemical from the chamber to the plunger.

Referring to the drawings, the valve device improvement to which the invention is particularly concerned is generally referred to by the numeral 100 and will be described in detail hereinafter. The valve device improvement 100 is for use in a well 10 having a well bore surface 12 drilled into the earth 14. Typical well string casing 16 exists within the well bore surface 12 and extends into the earth 14 to a gas and/or oil zone 18. A tubing string 20 is operably installed within the string casing 16 through which the gas and oil flow. Lubricator piping 22 is connected to the top of the tubing string 20.

A controller 23 is operably connected to the lubricator piping 22 and sales flow line 25. The controller 23 senses the pressure in the well 10 and can shut in the well 10 through an operable connection to a flow control valve 27.

An oil and gas flow enhancing substance 24 resides in a supply tank or other suitable container which can preferably be located adjacent the well 10. On top of the lubricator piping 22 is the valve device improvement 100. The valve device improvement 100 has a chamber 28 formed thereon with an open surface 30 therethrough for communicating between the lubricator piping 22 and chamber 28.

The valve device improvement 100 includes modifications to the delivery means which includes a chamber 28 communicably connected to a top of a well head via a threaded connection, for example. Operably disposed within the chamber 28 is a check valve device 101 which controls communication between two sections 102 and 104 of the chamber 28. More particularly, the check valve device 101 is disposed in an annular member 106 which extends radially inward from the chamber 28. An annular valve seat 108 is fixably disposed to a threaded adapter 109 which connects to an inner surface 110 of the annular member 106.

A ball valve cage 112 is fixably connected to a part of the threaded adapter 109 adjacent annular seat 108 and extends into the section 102. Openings 114 (e.g., four ⅜" ports evenly spaced) are formed in the ball valve cage 112 adjacent a first end near the annular seat 108. Another opening 116 (e.g., a ⅜" opening) is formed at a second end of the ball valve cage 112. Ball retainers 118 extend inwardly from the ball valve cage 112 and are disposed between the ends of the ball valve cage 112. A ball valve 120 is movably disposed within the ball valve cage 112 between a first closed position wherein the ball valve 120 is seated on the annular seat 108 to prevent fluid flow to pass therethrough at the first end and a second open position wherein the ball valve 120 is seated against opening 116 at the second end wherein fluid flow is permitted to pass through openings 114 and through annular seat 108.

A dip tube 122 includes a radially enlarged first end 124 an elongated second end 126 having a relatively smaller radius to the first end 124. The first end 124 also includes a cushioning member 128 (such as a Delrin™ cushion) for impact absorption when striking the ball valve 120. In this regard, the dip tube 122 is generally movably disposed wherein the elongated end 126 moves in the second section 104 with that the first end 124 capable of passing through the annular seat 108 to contact the ball valve 120. A first annular impact stop 130 for impacting a part of the threaded adapter 109 extends into the second section 104 adjacent annular member 106 receives the elongated end 126 therethrough while preventing the first end 124 from passing therethrough. A second annular impact stop 132 receives the elongated end 126 therethrough and a spring 134 is disposed between the stops 130 and 132 and biases against them. An annular member 136 extends radially inward within the section 104 to retain the stop 132.

Section 102 of the chamber 28 includes an area which receives the chemical 24 to be delivered into the well 10 through an opening 129 in the chamber 28. Operably disposed within the section 102 adjacent a terminal end of the section 102 is a spring retainer 138 (chemical spring follower) and a disk 140 (chemical chamber spring follower) and a spring 142 disposed therebetween which biases against them. The disk 140 has a protruding member 144 which is configured to extend through the opening 116 and displace the ball valve 120 from the open position to the closed position. The disk 140 has an annular seal 146 to prevent fluid passing thereby.

A controlled valve 50 connects to the chamber 28 through opening 129 and the supply tank of flow enhancing substance 24 and is controlled by controller 23 to enable a controlled amount of the substance 24 to enter the chamber 28 when the check valve ball 120 is in the closed position thus not enabling communication with the lubricator piping 22.

A plunger 48 is employed and is a similar type to that known in the art, such as an interlocking expandable, wobble washer, brush plunger, etc. In its simplest form, the plunger 48 can include an inlet 52 through which an amount of the substance 24 is received into an inner open surface 54 and upon reaching the well floor, the chemical 24 can be forced out through natural forces.

When the well 10 is shut in by the controller 23, pressure builds in the well 10 which causes the plunger 48 to rise and contact the dip tube 122 and in turn impact the impact stop 132 which drives it, the spring 134, and the stop 130 upward. This action closes gap between stop 132 and stop 130. The force from closing in the well 10 thus forces the first end 124 (ball impactor) up, through annular seat 108 (valve seat) to force check ball valve 120 off the seat 108. The first end 124 (ball impactor) continues in an upward direction forcing the check valve ball 120 up past the ball retainers 118. The check valve ball 120 remains suspended above ball retainers 118 allowing chemical to flow from section 102 (chemical chamber) down and around valve ball cage 112 and through the plurality of openings 114 (four ⅜" ports).

Once disk 140 (chemical chamber spring follower) in section 102 (chemical chamber) through force of the spring 142 pushes chemical through check valve 101 and reaches a top of valve ball cage 112, the protruding member 144 travels through opening 116 (e.g. ⅜" opening) and pushes check valve ball 120 down past ball retainers 118. This allows check valve ball 120 to free fall and seal back on annular seat 108. This completes cycle for chemical moving from section 102 (chemical chamber) through valve 100 and down, through dip tube 122 into plunger 48. The plunger 48 falls to the bottom of the well 10 once the flow is open as discussed herein.

The oil and gas flow enhancing substance 24 can be for example microorganisms, inhibitors, corrosion preventatives, paraffin solvents, foaming agents and/or gas expansion agents. The form of the substance 24 should be such to enable practice of the invention, which can preferably be liquid, or other gels or solids.

The well 10 is equipped with the controller 23 to open and shut the well fluid flow. The plunger 48 drops to the bottom of the well 10 or to a point where the plunger 48 impacts a fluid level. At such point, the impact the release of the substance 24 at the lower portion of the well begins chemically reacting releasing the oil and/or gas flow enhancing agent at the most desired point, the oil and/or gas zone. Once flow in the well diminishes below a predetermined flow rate as determined by the controller 23, the controller 23 shuts then the valve 27 and the cycle is repeated.

While the preferred embodiment of the present invention is illustrated and described, it is to be understood that this is capable of variations and modifications and therefore, the applicant does not wish to be limited to the precise details set forth, but desires to avail himself of such changes and alterations as fall within the purview of the following claims.

What is claimed is:

1. A chemical delivery system for a plunger lift for enhancing oil and gas recovery in a well having a well head and which employs a plunger, which includes:

a source of flow enhancing chemicals; and a chamber communicably connected to a top of the well head adjacent a sales flow line and substantially disposed on top of a tubing string and operably disposed thereon and including a ball check valve device which controls communication between a first section of said chamber which receives said flow enhancing chemicals therein from said source for delivery into the well and a second section of said chamber which communicates said flow enhancing chemicals received from said first section to a plunger which is movably disposed along said tubing string as a function of pressure within said tubing string in said well, and means for retaining said ball valve in one of an open position and a closed position as a function of the well being shut in, wherein said ball check valve device includes a ball valve cage in the first section, a first opening formed in said ball valve cage adjacent a first end, a second opening formed at a second end of said ball valve cage, a ball retainer extending inwardly from said ball valve cage and disposed between said ends of said ball valve cage, a ball valve movably disposed within said ball valve cage such that said ball valve can be disposed between the first closed position wherein said ball valve is seated on an annular seat to prevent fluid flow to pass therethrough at said first end and the second open position wherein said ball valve is seated against said second opening at said second end wherein fluid flow is permitted to pass through said first opening and through to said second section and which further includes a dip tube having a first end and a second end, wherein said dip tube is generally movably disposed within said second section and wherein said first end of said dip tube contacts said ball valve under force of the well and moves said ball valve to said open position.

2. A chemical delivery system for a plunger lift for enhancing oil and gas recovery in a well having a well head and which employs a plunger, which includes:

a source of flow enhancing chemicals; and a chamber communicably connected to a top of the well head adjacent a sales flow line and substantially disposed on top of a tubing string and operably disposed thereon and including a ball check valve device which controls communication between a first section of said chamber which receives said flow enhancing chemicals therein from said source for delivery into the well and a second section of said chamber which communicates said flow enhancing chemicals received from said first section to a plunger which is movably disposed along said tubing string as a function of pressure within said tubing string in said well, and means for retaining said ball valve in one of an open position and a closed position as a function of the well being shut in, wherein said ball check valve device includes a ball valve cage in the first section, a first opening formed in said ball valve cage adjacent a first end, a second opening formed at a second end of said ball valve cage, a ball retainer extending inwardly from said ball valve cage and disposed between said ends of said ball valve cage, a ball valve movably disposed within said ball valve cage such that said ball valve can be disposed between the first closed position wherein said ball valve is seated on an annular seat to prevent fluid flow to pass therethrough at said first end and the second open position wherein said ball valve is seated against said second opening at said second end wherein fluid flow is permitted to pass through said first opening and through to said second section and wherein operably disposed within said first section is a spring retainer, a disk, and a spring disposed between said spring retainer and said disk and biases thereagainst, said disk having a protruding member which is configured to extend through said second opening of said ball valve cage and displace said ball valve from said open position to said closed position.

3. The chemical delivery system of claim 1, wherein operably disposed within said first section is a spring retainer, a disk, and a spring disposed between said spring retainer and said disk and biases thereagainst, said disk having a protruding member which is configured to extend through said second opening of said ball valve cage and displace said ball valve from said open position to said closed position.

* * * * *